US006575206B2

(12) United States Patent
Struthers et al.

(10) Patent No.: US 6,575,206 B2
(45) Date of Patent: Jun. 10, 2003

(54) FUEL DISPENSER HAVING AN INTERNAL CATASTROPHIC PROTECTION SYSTEM

(75) Inventors: Kevin D. Struthers, Clayton, NC (US); Michael C. Webb, Raleigh, NC (US)

(73) Assignee: Environ Products, Inc., Smithfield, NC (US)

( * ) Notice: Subject to any disclaimer, the term of this patent is extended or adjusted under 35 U.S.C. 154(b) by 0 days.

(21) Appl. No.: 10/261,212

(22) Filed: Sep. 30, 2002

(65) Prior Publication Data

US 2003/0079801 A1 May 1, 2003

Related U.S. Application Data

(60) Provisional application No. 60/325,668, filed on Sep. 28, 2001.

(51) Int. Cl.[7] ..... B65B 1/04

(52) U.S. Cl. ..... 141/94; 141/311 A; 141/86; 700/244; 137/312

(58) Field of Search ..... 141/94, 86, 311 A, 141/83, 98; 700/244, 231, 21; 137/312

(56) References Cited

U.S. PATENT DOCUMENTS 6,006,773 A * 12/1999 Bravo ..... 137/15.08
6,170,539 B1 * 1/2001 Pope et al. ..... 141/59
6,182,679 B1 * 2/2001 Pendleton ..... 137/68.14

* cited by examiner

*Primary Examiner*—Steven O. Douglas
(74) *Attorney, Agent, or Firm*—Drinker Biddle & Reath LLP

(57) ABSTRACT

A fuel dispenser for service stations which comprises an integrated catastrophic protection system. The dispenser comprises a leak detector, an impact (or displacement) sensor, and a heat sensor for detecting dangerous conditions in or around the dispenser. The sensors may be connected to a processor within the dispenser or may send signals to a remote processor. Upon detection of any of the dangerous conditions, a system controller can take appropriate action to shut down part or all of the fuel system in the facility to avoid a fuel catastrophe.

3 Claims, 2 Drawing Sheets

FUEL DISPENSER HAVING AN INTERNAL CATASTROPHIC PROTECTION SYSTEM

RELATED APPLICATIONS

This application claims priority from a provisional application, serial No. 60/325,668, filed Sep. 28, 2001.

FIELD OF THE INVENTION

This invention relates to the field of advanced fuel dispenser equipment, particularly dispensers for use by the public and attendant staff at gasoline service stations, and dispensers used in any other facilities for fueling vehicles, aircraft and marine craft.

BACKGROUND OF THE INVENTION

Many fueling facilities today have self service fueling as well convenience stores and restaurants. As a result there is a lot of traffic at fueling facilities which includes customer vehicles, fuel delivery tanker trucks and merchandise delivery trucks. The facility attendants are always busy typically not well trained to handle a fueling equipment emergency, such as fuel leak or a fire at a dispenser due to a vehicle impact, a weather event or any other act of God.

In the event of an impact to a fueling dispenser it is possible that the fuel piping and associated piping connections located either underneath or inside the dispenser could begin to leak or rupture causing a fire or possibly contaminate the surrounding environment.

A undetected fuel leak at a dispenser, no matter how slow has the potential of causing a catastrophic problem. An uncontained fuel leak could escape into the environment causing a possible ground contamination problem, like pollution of ground water.

A more immediate problem could be that of a major fuel leak caused by internal damage to a fuel dispenser due to a vehicle impact. This impact to the fuel dispenser could generate a spark from damaged electrical connections or from static electricity causing a fire. Fuel dispensers that are installed at fueling facilities having pressurized fuel delivery systems include a fuel delivery pump located at the underground fuel storage tank. This fuel delivery pump supplies fuel to all of the fuel dispensers and therefore could continue to supply fuel to the damaged dispenser that could be on fire. Pressurized fuel delivery systems require that safety valves be installed directly under the dispensers to shut off the fuel to a damaged dispenser, but if for some reason one or more of these safety valves was damaged during the impact or malfunctions and fuel was not shut off, the resulting fire could be catastrophic.

A common procedure today is that the facility's attendant would press an "Emergency Stop Button" to shut off power to all of the fuel delivery pumps and dispensers instantly, providing the attendant is aware of the event. Historically this manual response system to a dispenser fire has to failed causing personal injury and even death.

Currently on the market today there are a variety independent devices, not supplied by the dispenser manufacturers, that could be used together to create a catastrophic protection system for one or more dispensers. Typically these devices are sold separately and are collectively expensive. Examples of these devices are listed as follow:

1. Shear Valves: One or more safety valves are required to be mounted underneath fuel dispensers which are part of pressurized fuel delivery systems. These mechanically actuated valves are designed to automatically close one or two internal valves instantly upon significant impact to the dispenser or due to high heat produced from a fire. These valves prevent the pressurized fuel from continuing to feed a fire or leak product into the environment.
2. Impact Actuation Devices: These type independent trip type sensors are designed to shut-off power to the dispenser(s) and/or fuel deliver pump(s) upon significant impact to the dispenser. They are supplied separately from the dispensers and can be costly to purchase and install.
3. Leak Detection Devices: There are a variety of independent leak detection devices that are designed to signal an alarm and/or shut off power to the fuel delivery pump and/or dispenser in the event of a fuel leak detected by the leak detection sensor installed typically in a containment sump located under the dispenser.

Some leak detection sensors are only one component of a larger leak detection system which may include many leak detection sensors, a number of liquid level tank gauging sensors, a independent monitoring box or a modular monitoring component as part of a POS (point of sale) system.

There are other types of stand-alone leak detection sensors that can be mounted under the fuel dispenser and inside a containment sump that require no monitoring box and that automatically signal an alarm at the dispenser or turn-off the dispenser in the event of detecting a leak. These devices are usually complicated sensors, experience false alarms and are expensive to purchase and maintain.

As far as is presently known, there are no independent devices on the market that are designed to mounted inside or under a dispenser that will automatically shut-off the power to the dispenser and/or fuel delivery pump in the event of a fire at the dispenser.

It is important that retail fueling facilities have a fail-safe system to protect fueling customers from fire that could result from a dispenser impact. In addition it is also important to have the capability to detect even the smallest of leaks which can originate from faulty plumbing connections, faulty equipment or damage from a mild impact to a dispenser that may go undetected. Fuel leaks, no matter how slow, will collect inside containment sump therefore having the potential to cause a fire or explosion explode ignited from a customer's cigarette, a static charge or faulty electrical connection. Additionally undetected fuel leaks could overflow a containment sump and escape into the surrounding environment contaminating the environment and possibly our underground drinking water.

The main reasons most retail fueling facilities do not offer completely fail-safe catastrophic protection systems for all of their dispensers is because it is to costly, difficult to install and maintain.

SUMMARY OF THE INVENTION

The invention is a fuel dispenser that is factory equipped with an integrated catastrophic protection system. This system is designed to provide fire protection, impact protection and leaking fuel protection. It is not a prevention system but rather an immediate response system that will instantly shut off power to the fuel delivery pump and/or fuel dispenser as well as signal an alarm upon detection of a impact, fire or leak.

The invention is a very low cost catastrophic protection system which is included as a standard feature of the fuel dispenser. The only cost to the buyer would be for replacement parts such as replacement leak detection sensors.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
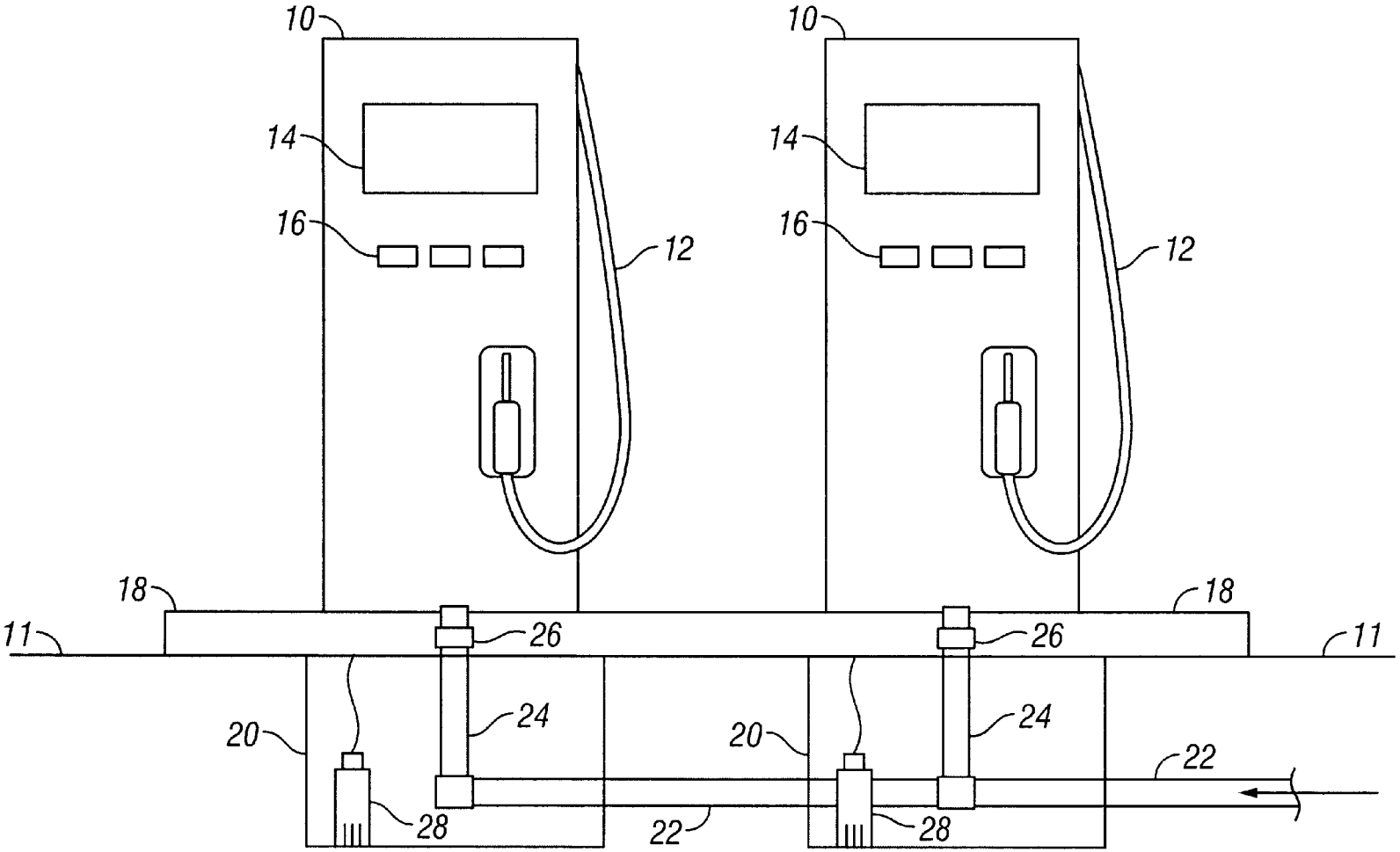
FIG. 1 is an elevation diagram of fuel dispensers in standard, prior art configuration.

Referring to the drawings, in which like numbers indicate like elements of the apparatus, FIG. 1 depicts a basic service station fuel dispenser 10 and its associated hardware. A dispenser 10 normally sits upon an island 18 raised above ground level 11. Basic components of a dispenser are a visual display 14 which in older dispensers are mechanical and in more recent models have become electronic. There are normally fuel grade/price indicators 16 that on some dispensers also act as the selection buttons to choose which grade of gasoline is to be dispensed to the vehicle. The dispenser includes a hose/nozzle assembly 12 to deliver fuel to the vehicle.

In more recently equipped service stations, the equipment under the dispenser (and below ground) includes a chamber 20 for containing any fuel that might leak from the pipes and couplings in and under the dispenser 10. FIG. 1 shows a fuel supply pipe 22 running below ground to the two dispensers 10 shown. This pipe 22 is representative of the three pipes that normally supply fuel to a dispenser, one pipe carrying each grade of fuel. Coupled to the pipe 22 are riser pipes 24 that feed the fuel up into the dispensers 10. Again the FIG. 1 illustration shows only one of the three riser pipes that are normally connected to a dispenser 10.

Two elements of safety equipment are normally found in more recently installed dispensers. One is a leak detector 28 that detects and signals the presence of a leak to the station operator. The second is a shear valve 26 at the base of the dispenser, one shear valve for each riser pipe 24 connected to the dispenser 10. A shear valve is a passive device that is designed to close off the flow of fuel into the dispenser if the connection between the shear valve 26 and the dispenser 10 is broken, as would occur if a vehicle crashed into the dispenser. The shear valve 26 quickly shuts off the fuel flow so that a large amount of fuel cannot spray from the dispenser 10 riser pipe 24 and feed a catastrophic fire.

Though the shear valve and leak detectors lend a degree of safety to modem fuel dispensers that was not present in the dispensers of earlier days, they do not protect against all potential catastrophic events that can occur in or be suffered by a fuel dispenser. It is the purpose of the present invention to include more safety capabilities and to tie the safety features together in a computer-controlled safety system that will prevent most fuel accidents at service stations.

Figure 2:
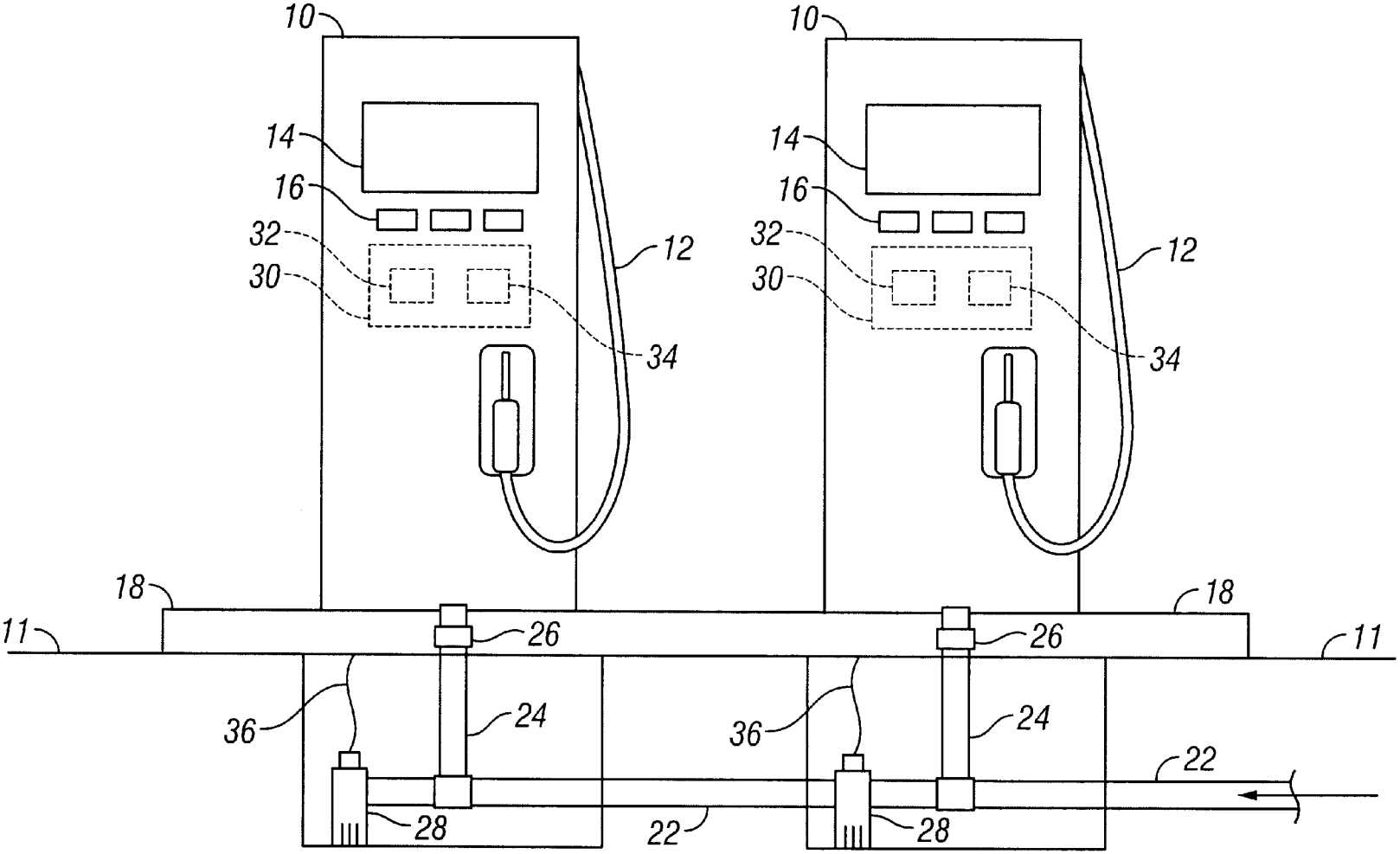
FIG. 2 is an elevation diagram of the fuel dispensers of the invention.

Referring to FIG. 2, there is shown a fuel dispenser 10 having additional safety elements. Along with the shear valve 26 and leak detector 28, this dispenser is equipped with an impact sensor 32 and a heat sensor 34. The function of the impact sensor 32 is to detect any displacement of the dispenser 10 that threatens to affect the connection of the dispenser to the riser pipe 24, or to damage the internal fuel conveyance pathway (not shown) through the dispenser to the hose/nozzle assembly 12. Either of these results could cause significant fuel leaks. It is possible to impact and damage the fuel dispenser, and thereby cause a leak, without causing the shear valve to be activated by a complete breakaway. The fuel delivery system is pressurized and any damage to the internal works of the dispenser 10, which includes piping and several meter devices, could cause a fuel spray leak that is not controlled by the shear valve 26.

It should be noted that, although the sensor is referred to herein as an "impact" sensor, this sensor is intended to signal any physical displacement of the dispenser whether the result of a violent impact or not (e.g., earthquake).

A second added dispenser safety feature is a heat sensor 34. Fires occur in and around fuel dispensers for reasons other than physical impact. Most of these are attributable to operator errors, including smoking while fueling a vehicle. A customer who smokes and spills a significant quantity of fuel from the dispenser nozzle can cause a very dangerous fire in a split second. The heat sensor 34 can detect the high temperature of a fire that threatens a fuel dispenser and its associated fuel supply system. Per the present invention, the heat sensor 34 is tied into the control systems that operates the fuel delivery system for the station. The system can be shut down on detection of high temperature indicating a fire.

An important aspect of the invention is tying the safety devices electronically to a computer control system so that automatic shutdown of the fuel delivery system in the service station can be effected. Thus, the leak detector 28 in FIG. 2 is shown with a wire 36 running up into the dispenser 10. The heat sensor 34 and the impact sensor 32 are similarly connected to a processor. In the present embodiment of the invention, the heat detector 34 and the impact sensor 32 each reside on circuit boards (not shown) within the dispenser 10. It will be apparent to one skilled in the art of computer systems that the control processor for the sensors can be located either in the dispenser or at the host computer. FIG. 2 shows a processor 30 (in shadow) located in the dispenser 10. If so located, the processor 30 can be programmed to monitor each of the safety devices 26, 28, 32, 34 simultaneously. Upon detecting a signal from any one of the them that indicates a dangerous condition, the processor can send to the host computer a signal indicating detection of the hazard condition so that the host computer could take the necessary control action. Usually, the action is an alarm, system shutdown, or both.

This description refers to a "host" computer because in modern systems the fuel delivery apparatus is computer controlled. Therefore, it is the host computer that has operating responsibility for each of the components of the system. The host computer is normally located in the service station office, though that is not a necessity.

It is also possible to run the safety device detection signals from each dispenser to the host computer without having a processor in the dispenser performing any monitoring. In that eventuality, the host would directly monitor the safety status of each dispenser in the system. In the event that the signal is lost from any of the safety devices, or from an individual dispenser controller (if one is installed), the system default action should be shutdown. It is possible that a signal loss would be the only indication that a vehicle crash or explosion had destroyed the dispenser and its communication electronics.

The impact sensor 32 in the invention can be one of several types of device known to those skilled in electronic motion detection. A mercury switch or other type of inertial device, combined with an electronic transducer, that would react to a shock or displacement and present an electronic pulse signaling the event would suffice. This sensor preferably would detect not only a sharp impact, but also a tilt condition that may result from something less than a violent impact.

The heat sensor also can be one of several varieties combined with an electronic transducer for producing an electronic signal upon reaching a critical temperature threshold. That threshold should be much higher than any temperature that can be reached in the hottest weather under direct sunlight. But it should be low enough that detection of a local fire could be achieved rapidly enough to prevent a catastrophic explosion. Because fuel fires burn at over 1000 degrees, a temperature trigger in the range of 300 degrees Fahrenheit should be above any natural causes and be low enough to cause rapid detection of a fire.

The dispenser of the present invention has the safety features integrated in it. The dispenser provides electronic inputs for the leak detection device 28 located in the chamber below the dispenser. The heat and impact sensors are integrated into the dispenser electronics. The integrated catastrophic protection subsystem can be programmed and wired to perform as follows:

A. Triggering Events

1. Impact Event: If there is an impact to a dispenser that exceeds a preset force level or the dispenser is tilted more than a preset angle then a triggering event shall occur.
2. Fire Event: If the temperature inside the dispenser exceed a preset temperature level then a triggering event shall occur.
3. Leak Event: If the leak detection sensor that is connected to the dispenser and extends down into the containment sump located under the dispenser senses the presence of fuel then a triggering event shall occur.

B. Event Responses (one or more of the following responses)

1. Shut off power to the impacted or tilted dispenser
2. Shut off power to all fuel dispensers
3. Shut off power to all fuel delivery pumps
4. Signal an audible alarm originating the impacted dispenser.
5. Signal a visual and/or audible alarm the POS monitors
6. Signal a visual and/or audible alarm to an off-site location C. System Reset Requirements 1. Can be reset only after dispenser is perfectly upright.
2. Can be reset only after temperature has fallen below preset level.
3. Can be reset only after leak detection sensor has been reinstated.
4. Can be reset only by the manual reset button located inside the dispenser.

Even though particular embodiments of the present invention have been illustrated as described herein, it is not intended to limit the invention and changes and modifications may be made therein by persons skilled in the art within the scope of the following claims.

We claim:

1. A fuel dispenser having an integrated catastrophic event protection system comprising:

a fuel dispenser apparatus comprising
a fuel delivery apparatus,
an electronic leak detection device that comprises a signal connection into the dispenser,
an impact sensor in the dispenser that detects a displacement of the dispenser and causes an electronic signal to be generated signaling the event,
a heat sensor that detects heat within the immediate environment of the dispenser beyond that which is normally occurring and causes an electronic signal to be generated signaling the event, and
a computer processor to which the signals from the leak detection device, the impact sensor and the heat sensor are electronically connected, said processor having an electronic signal line to a remote computer controller for signaling a dangerous condition in the fuel dispenser apparatus.

2. A fuel dispenser having an integrated catastrophic event protection system comprising:

a fuel dispenser apparatus comprising
a fuel delivery apparatus,
an electronic leak detection device that comprises a signal connection into the dispenser,
an impact sensor in the dispenser that detects a displacement of the dispenser and causes an electronic signal to be generated signaling the event,
a heat sensor that detects heat within the immediate environment of the dispenser beyond that which is normally occurring and causes an electronic signal to be generated signaling the event, and
a computer processor to which the signals from the leak detection device, the impact sensor and the heat sensor are electronically connected, said processor being configured so as to shut down the dispenser upon occurrence of a dangerous condition.

3. A fuel dispenser having an integrated catastrophic event protection system comprising:

a fuel dispenser apparatus comprising
a fuel delivery apparatus,
an electronic leak sensor that comprises a signal connection into the dispenser,
an impact sensor in the dispenser that detects a displacement of the dispenser and causes an electronic signal to be generated signaling the event,
a heat sensor that detects heat within the immediate environment of the dispenser beyond that which is normally occurring and causes an electronic signal to be generated signaling the event,
each of said sensors being connected to a remote system controller, said controller being configured so as to shut down the dispenser upon occurrence of a dangerous condition.

* * * * *